US006817881B2

(12) United States Patent
Chou

(10) Patent No.: US 6,817,881 B2
(45) Date of Patent: Nov. 16, 2004

(54) FAST ASSEMBLY STRUCTURE MODULE

(75) Inventor: Chi-Wen Chou, Taipei (TW)

(73) Assignee: First International Computer, Inc., Taipei (TW)

( * ) Notice: Subject to any disclaimer, the term of this patent is extended or adjusted under 35 U.S.C. 154(b) by 0 days.

(21) Appl. No.: 10/372,956

(22) Filed: Feb. 26, 2003

(65) Prior Publication Data

US 2004/0166712 A1 Aug. 26, 2004

(51) Int. Cl.[7] ..... H01R 4/50
(52) U.S. Cl. ..... 439/342
(58) Field of Search ..... 439/342; 361/685; 312/223.2

(56) References Cited

U.S. PATENT DOCUMENTS 5,587,879 A * 12/1996 Spano et al. ..... 361/685
6,238,026 B1 * 5/2001 Adams et al. ..... 312/223.2
6,299,266 B1 * 10/2001 Justice et al. ..... 312/223.2
6,667,880 B2 * 12/2003 Liu et al. ..... 361/685

FOREIGN PATENT DOCUMENTS

TW 509459 11/2002

* cited by examiner

*Primary Examiner*—Phuong Dinh
(74) *Attorney, Agent, or Firm*—Troxell Law Office of PLL

(57) ABSTRACT

A fast assembly structure module comprises a seat body connected to at least one control unit. The seat body has at least three plate bodies. Each plate body has a connection hole. The control unit has an arm. A retaining plate, which can be controlled to insert in and extract out of a corresponding connection hole, is controlled by the arm. The retaining plate is retracted by use of the arm. An electrical component having a plurality of projection sticks, each of which is removably inserted into the connection hole of one of the at least three plate bodies, is releasably locked to the seat body by the retaining plate and inserted into and removed from the seat body by using to arm to displace the retaining plate.

9 Claims, 4 Drawing Sheets

FAST ASSEMBLY STRUCTURE MODULE

BACKGROUND OF THE INVENTION

1. Field of the Invention

The present invention relates to an assembly structure concerning products such as computer and electronics, and more particularly to a structure that is able to assemble modules quickly.

2. Description of Related Art

A computer or AV electronic product has a housing for assembling a power supply, heat dissipation device, PCB, disc driver, transmission controller and etc. therein. Corresponding grooves or holes are always disposed in these components for fixing them in the housing by screws.

Taiwan patent No. 509459 reveals a screw-free positioning device for computer reading and writing machine. A bracket is installed in a computer main frame. And, the computer reading and writing machine, such as floppy disk or hard disk driver or compact disk driver, has a engaging groove at its outer side wall to combine with a positioning plate corresponding to a engaging body. First, place the computer reading and writing machine into the bracket while assembling, then, seal the computer main frame with a panel to limit the positioning plate in a sliding rail so as to allow the first and the second withstander bodies to press against the two ends of the positioning plate to fix the reading and writing machine in the main frame.

The panel must be utilized in the positioning device mentioned above to fix the computer reading and writing machine, and consequently, the positioning device cannot fix components that are not adjacent to the panel. Therefore, it is not suitable for being an assembly structure module.

SUMMARY OF THE INVENTION

The division of labor in electronics becomes more detailed. For example, a housing, PCB, hard disc driver, power supply and compact disc driver can be produced separately from different countries and areas and then be assembled into a personal computer at a country and area. It is convenient for electronics product assembly so as to save manpower and cost, if an assembly structure module is developed.

The main object of the present invention is to provide a fast assembly structure module, enabling all components to be assembled quickly in a housing of an electronics product so as to reduce assembly time and to save cost.

Another object of the present invention is to provide a fast assembly structure module, enabling all damaged components to be changed conveniently when maintenance is needed.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
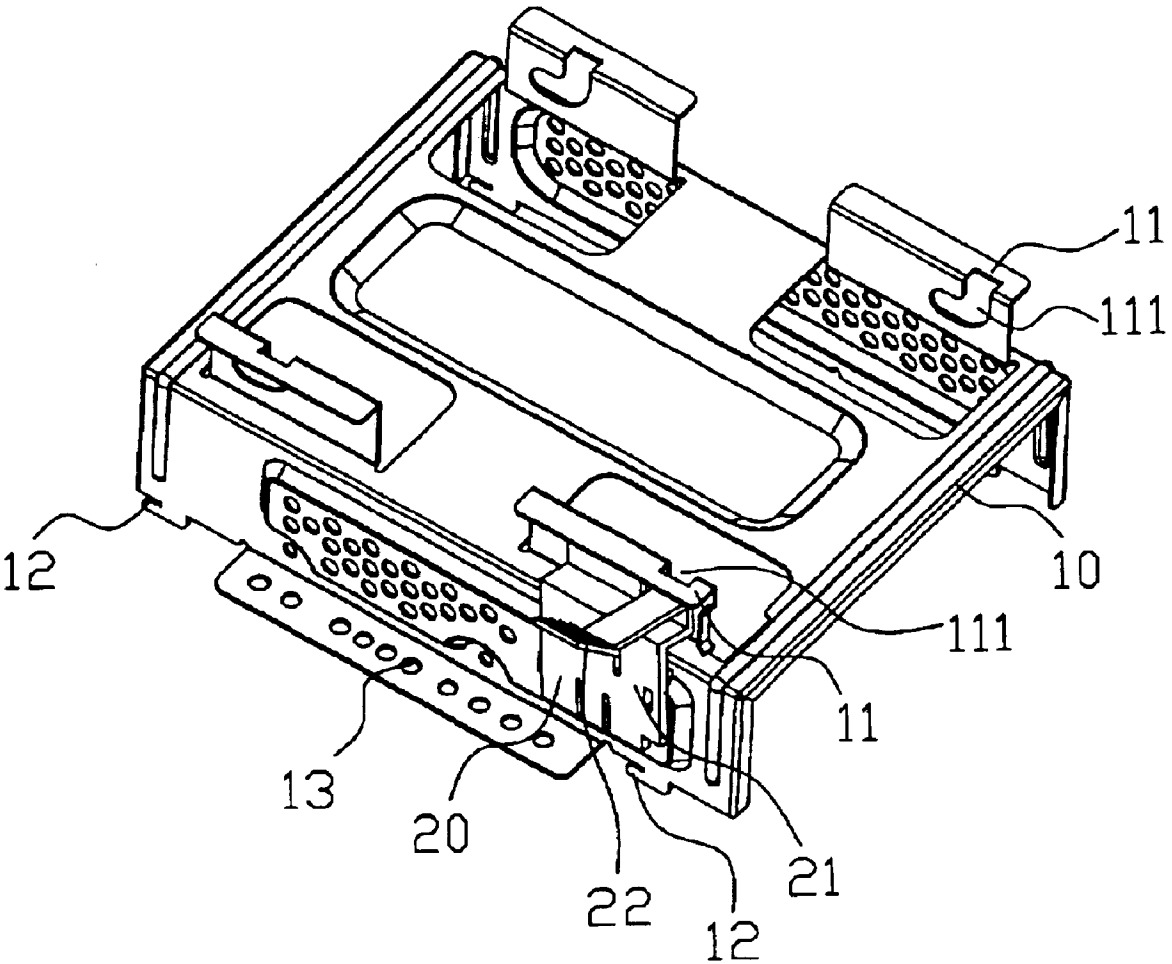
FIG. 1 is a schematic view of connection of a seat body and control unit of an embodiment according to the present invention.
Figure 3:
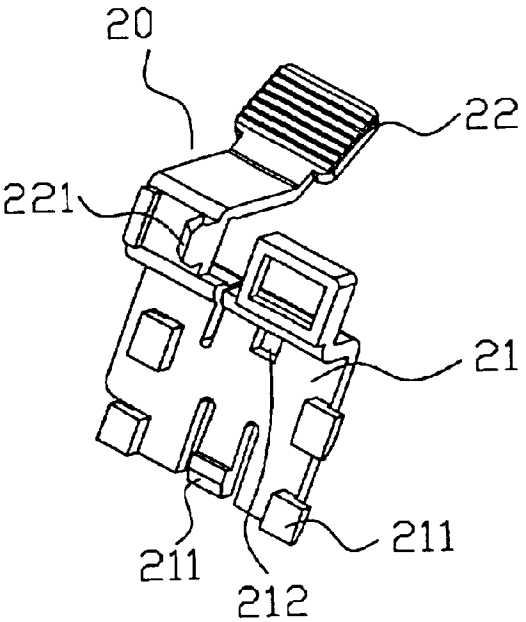
FIG. 3 is a schematic view of a control unit of an embodiment according to the present invention.
Figure 2:
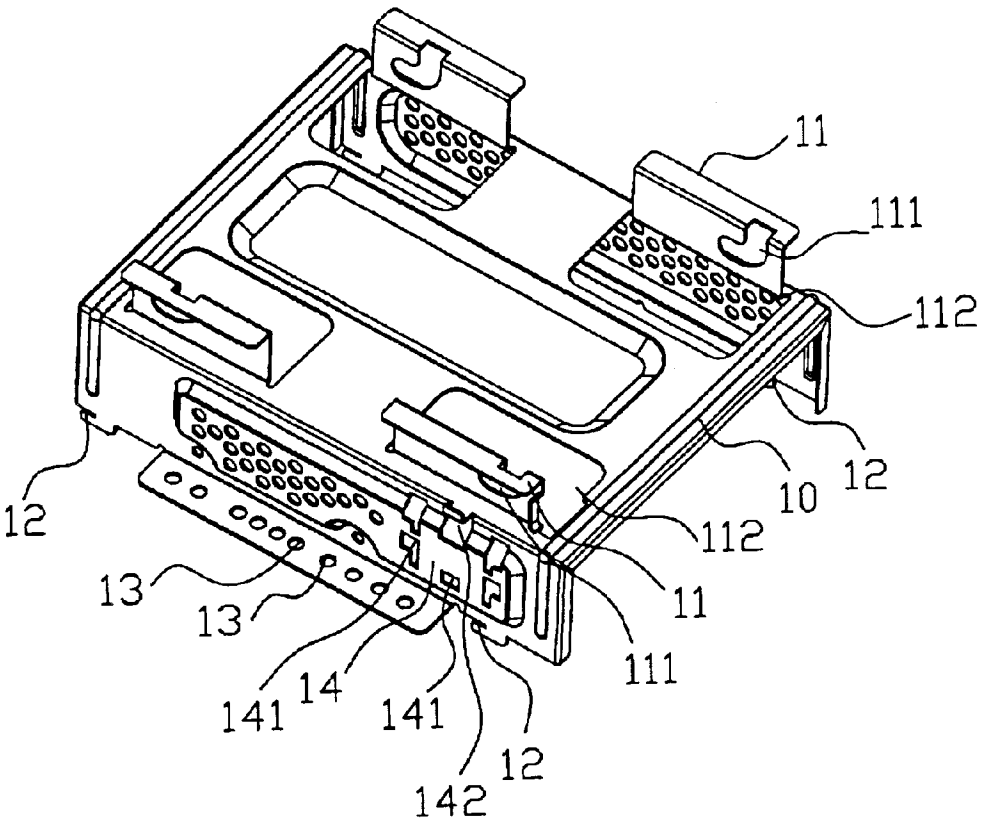
FIG. 2 is a schematic view of a seat body of an embodiment according to the present invention.

Please refer to FIGS. 1, 2 and 3. A fast assembly structure module of an embodiment according to the present invention comprises a seat body 10 connected with at least a control unit 20. The upper end of the seat body 10 (refer to FIG. 2) at least has 4 plate bodies 11; the lower end thereof has fastener ears 12 and assembly holes 13. Each plate body 11 has a connection hole 111 and is formed by bending a plate upward from one side of each opposite hole 112 in the seat body 10. The seat body 10 at least has a faster part 14 adjacent to the plate bodies 11. A plurality of fastener holes 141 and wedging ears 142 are disposed in the fastener part 14. The control unit 20 (please refer to FIG. 3) has a connection plate 21 and arm 22. The connection plate 21 has a plurality of fastener plates 211 and wedging holes 212 matched up with the fastener holes 141 and the wedging ears 142 of the fastener part 14 of the seat body 10 in order to allow the fastener plates 211 and wedging ears 142 to pass through the fastener holes 141 and wedging holes 212 and is fasten to the sides of the fastener holes 141 and wedging holes 212 respectively. Thereby, the control unit 20 can be connected to the seat body 10 (as FIG. 1 shows). The arm 22 projects out from one side of the connection plate 21; a retaining plate 221, which is corresponding to the connection hole 111 and has a single inclined face projecting toward the right side of FIG. 3, is disposed at the arm 22 and can be inserted into the connection hole 111. The control unit 20 is made from elastic plastic or metal. The fastener ears 12 and assembly holes 13 at the lower end of the seat body 10 are used to match up with the fastener grooves or holes at a housing or other assembly components and fastened with them directly or through screws.

Figure 5:
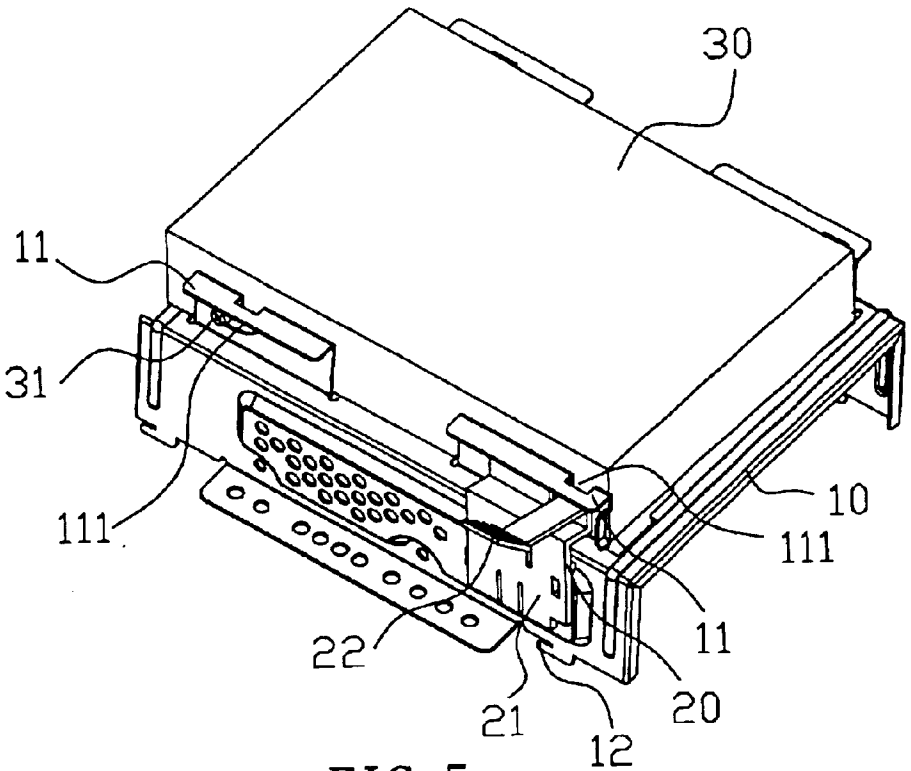
FIG. 5 is a schematic view of connection of a seat body and components of an embodiment according to the present invention.
Figure 4:
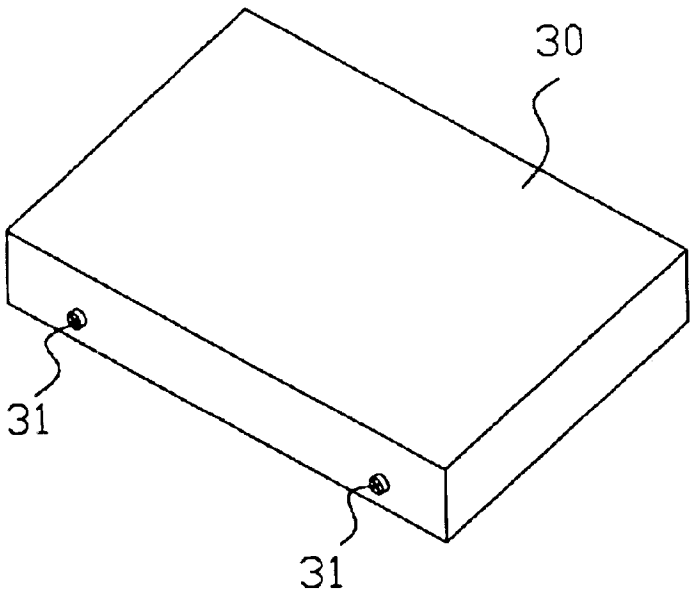
FIG. 4 is a schematic view of components of an embodiment according to the present invention.
Figure 7A:
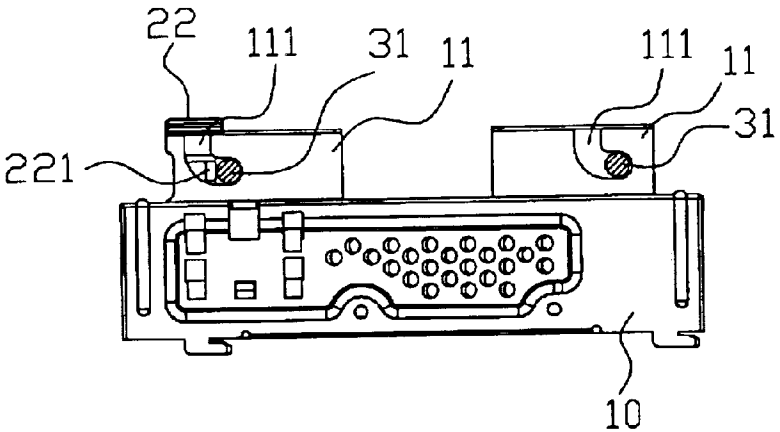
FIG. 7A is a schematic view of an embodiment according to the present invention, showing a seat and component after connection.
Figure 7B:
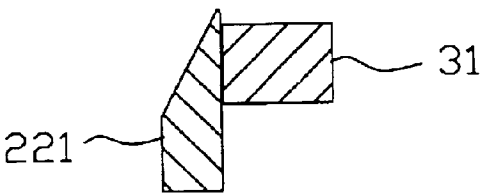
FIG. 7B is a schematic view of an embodiment according to the present invention, showing that a retaining plate stops a projection stick.
Figure 6A:
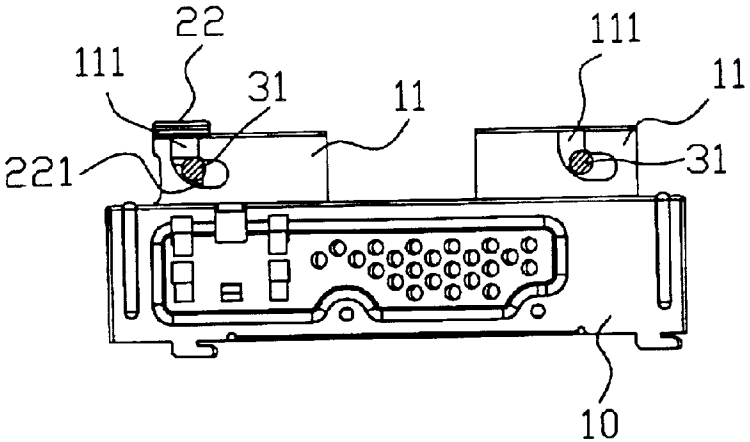
FIG. 6A is a schematic view of an embodiment according to the present invention, showing a seat and component before connection.
Figure 6B:
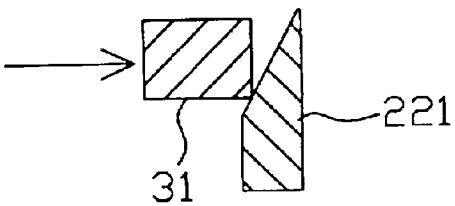
FIG. 6B is a schematic view of an embodiment according to the present invention, showing that a projection stick thrusts against a single inclined face of a retaining plate.

Next, please refer to FIGS. 4 and 5, the figures shows a component 30 that can match up with a fast assembly structure module of an embodiment according to the present invention. Four projection sticks 31, which can be assembled into four connection holes 111 in the seat body 10, are disposed at side plates of the component 30. The projection sticks 31 can be connected to the side plates of the component 30 through screws.

Please refer to FIGS. 6A, 6B, 7A and 7B. Other tools are not needed when the component 30 is assembled to the seat body 10. The only thing we need is to insert the projecting stick 31 on the component 30 into the connection hole 111 of the plate body 11. And then, press slightly on the component 30 so that the projecting stick 31 can thrust the retaining plate 221 in the connection hole 111 toward the direction that the projection stick 31 thrusts and gradually toward the single inclined face (or curved single inclined face) that projects out, so that the retaining plate 221 cane withdrawn out from the connection hole 111 (please refer to FIGS. 6A and 6B). The retaining plate 221 is not more thrust by the projecting stick 31 and its elasticity is recovered to block the exit of the connection hole 111 so as to limit the projection stick 31 at the lowest end of the connection hole 111 when the projection stick 31 enters the lowest end of the connection hole 111. Thereby, the fast assembly and positioning of the component 30 and the seat body 10 can be obtained.

Furthermore, other tools are also not needed when the component 30 is retracted. The only thing we need is to press down the arm 22 of the control unit 20 to separate the retaining plate 221 from the connection hole 111 so as not to block the exit of the connection hole 111. And then, the projecting stick 31 of the component 30 can be withdrawn from the connection. Thereby, the component 30 cane easily retracted. Besides, three plate bodies 11, which each has its own connection hole 111, are arranged to be a triangle to receive a component 30 with three corresponding projecting sticks 31. Thereby, a fast assembly and positioning can be obtained.

A housing of a general electronics product connected with a fast assembly structure module according to the present invention can be assembled with a component with projecting sticks quickly. Thereby, assembly time can be reduced and cost can be saved. Furthermore, a damaged part can be easier changed when maintenance is needed.

It is noted that the fast assembly structure module described above is the preferred embodiment of the present invention for the purpose of illustration only, and are not intended as a definition of the limits and scope of the invention disclosed. Any modifications and variations that may be apparent to a person skilled in the art are intended to be included within the scope of the present invention.

What is claimed is:

1. An assembly module for an electrical component having a plurality of projection sticks comprising:

a) a seat body having:

i) at least three plate bodies extending upwardly from a top of the seat body, each of the at least three plate bodies has a connection hole, one of the plurality of projection sticks of the electrical component is removably inserted into the connection hole of each of the at least three plate bodies; and ii) at least one fastener part located adjacent to one of the at least three plate bodies and having a plurality of fastener holes and wedging ears; and b) at least one control unit having:

i) a connection plate connected to the at least one fastener part;

ii) an arm connected to the connection plate and movable between released and depressed positions; and iii) a retaining plate removably inserted into the connection hole located adjacent to the at least one fastener part and controlled by the arm, wherein, when the arm is in the released position, the retaining plate is located in the connection hole located adjacent to the at least one fastener part to lock a predetermined projection stick of the plurality of projection sticks of the electrical component in the connection hole subsequent to the electrical component being inserted into the seat body, and, when the arm is in the depressed position, the retaining plate is withdrawn from the connection hole located adjacent to the at least one fastener part thereby releasing the predetermined projection stick, such that the electrical component is inserted and removed from the seat body.

2. The assembly module according to claim 1, wherein the retaining plate includes a single inclined face.

3. The assembly module according to claim 1, wherein the seat body includes a plurality of fastener ears.

4. The assembly module according to claim 3, wherein each of the plurality of fastener ears are located on a bottom of the seat body.

5. The assembly module according to claim 1, wherein the seat body includes a plurality of assembly holes.

6. The assembly module according to claim 5, wherein each of the plurality of assembly holes are located on a bottom of the seat body.

7. The assembly module according to claim 1, wherein the arm is made of an elastic material.

8. The assembly module according to claim 1, wherein the connection plate of the at least one control unit has a plurality of fastener plates and wedging holes inserted into the plurality of fastener holes and wedging ears respectively.

9. The assembly module according to claim 1, wherein each of the at least three plate bodies is bent along the connection hole.

* * * * *